US010433654B2

(12) United States Patent
Deng

(10) Patent No.: US 10,433,654 B2
(45) **Date of Patent: *Oct. 8, 2019**

(54) MATTRESS WITH ADJUSTABLE HARDNESS

(71) Applicant: TangTring Seating Technology Inc., Huizhou, Guangdong (CN)

(72) Inventor: Xing-Ming Deng, Guangdong (CN)

(73) Assignee: TANGTRING SEATING TECHNOLOGY INC., Guangdong (CN)

( * ) Notice: Subject to any disclaimer, the term of this patent is extended or adjusted under 35 U.S.C. 154(b) by 342 days.

This patent is subject to a terminal disclaimer.

(21) Appl. No.: 15/454,711

(22) Filed: Mar. 9, 2017

(65) Prior Publication Data

US 2018/0255939 A1 Sep. 13, 2018

(51) Int. Cl.
*A47C 27/08* (2006.01)
*A47C 27/18* (2006.01)
*A47C 27/06* (2006.01)

(52) U.S. Cl.
CPC ..... *A47C 27/087* (2013.01); *A47C 27/061* (2013.01); *A47C 27/063* (2013.01); *A47C 27/082* (2013.01); *A47C 27/18* (2013.01)

(58) Field of Classification Search
CPC ..... A47C 27/087; A47C 27/18; A47C 27/063; A47C 27/061; A47C 27/082; A47C 27/08; A47C 27/081; A47C 27/10; A47C 27/00; A47C 27/128; A47C 27/14; A61G 7/05769; A61G 7/05776
See application file for complete search history.

(56) References Cited

U.S. PATENT DOCUMENTS 3,564,628 A * 2/1971 Oxford ..... A47C 27/15 5/707
4,042,988 A * 8/1977 Holliday ..... A47C 27/081 5/691
4,424,600 A * 1/1984 Callaway ..... A47C 27/061 5/485

(Continued)

FOREIGN PATENT DOCUMENTS

CN 201270999 Y 7/2009

*Primary Examiner* — Robert G Santos
*Assistant Examiner* — Myles A Throop
(74) *Attorney, Agent, or Firm* — Muncy, Geissler, Olds & Lowe, P.C.

(57) ABSTRACT

A mattress with adjustable hardness comprises at least one resilience supplying module, at least one air bag module and a lining provided for the resilience supplying module and the air bag module to be placed therein. The lining is provided with a plurality of lattice-like units, each lattice-like unit defining a mounting space therein. The resilience supplying module is provided with a plurality of elastic bodies respectively provided in one of the mounting spaces. The air bag module is provided with a plurality of air bag units respectively provided in one of the mounting spaces. In this case, the air bag units may be inflated consistently, and the expanded volume of each of the air bag units after inflation may be limited to be uniform by the corresponding lattice-like unit. Thus, the problem of incapability of being kept evenness after inflation in the conventional practice is solved.

10 Claims, 7 Drawing Sheets

(56) References Cited

U.S. PATENT DOCUMENTS

| | | | | | |
|---|---|---|---|---|---|
| 5,566,409 | A * | 10/1996 | Klearman | A47C 27/082 | 5/706 |
| 6,092,249 | A * | 7/2000 | Kamen | A47C 4/54 | 5/653 |
| 6,510,573 | B1 * | 1/2003 | Grabe | A47G 9/1027 | 5/490 |
| 7,818,831 | B2 * | 10/2010 | Mahdjoubi | A61G 7/05769 | 5/613 |
| 10,070,732 | B1 * | 9/2018 | Deng | A47C 27/081 | |
| 2002/0116766 | A1 * | 8/2002 | Stolpmann | A47C 27/084 | 5/710 |
| 2003/0009831 | A1 * | 1/2003 | Giori | A47C 27/084 | 5/709 |
| 2004/0226103 | A1 * | 11/2004 | Reger | A61G 7/05753 | 5/713 |
| 2005/0125905 | A1 * | 6/2005 | Wilkinson | A47C 27/082 | 5/713 |
| 2007/0186349 | A1 * | 8/2007 | Lipman | A47C 27/084 | 5/713 |
| 2008/0201856 | A1 * | 8/2008 | Howard | A47C 27/001 | 5/690 |

* cited by examiner

MATTRESS WITH ADJUSTABLE HARDNESS

FIELD OF THE INVENTION

The present invention is related to a mattress with adjustable hardness, particularly to an inflatable mattress kept evenness when inflated.

BACKGROUND OF THE INVENTION

Nowadays, as technology develops highly, quality requirements for food, clothing, housing, transportation, education, and entertainment are increased day after day. It may be found that, in terms of "housing", a mattress provided therein with several air bags used for adjusting the hardness by a user is nowadays presented on the market in addition to a general mattress constituted by sponge. For instance, an inflatable bed, as disclosed in China patent publication no. CN 201270999, comprising a bed body, a mattress, a headboard backrest, a plurality of air cells, a bearing layer of air cell and a shape controlling layer. In this case, the mattress is provided on the surface of the bed body, and the headboard backrest is provided on the bed body near the side thereof. The air cells are arranged inside the bed body and independently without communicating with one another. The bearing layer of air cell and the shape controlling layer are configured to cover these air cells. In the practical use of the inflatable bed, the air cells may be inflated by a user so as to adjust the hardness of the bed body. The bearing layer of air cell and the shape controlling layer are then used for limiting the expanded shape of the air cell so as to avoid deformation of the bed body.

During the patent no. CN 201270999 is embodied, however, it may be found that the air cells are expanded inconsistently after inflation due to independent of the air cells without communicating with one another, and further, discomfort is thus perceived by a user lying on the mattress due to lumpiness. Furthermore, the bed body is incapable of being sustained by the air cells evenly in the inflatable bed, because the range of expansion of the air cells is limited by the bearing layer of the air cell and the shape controlling layer together.

SUMMARY OF THE INVENTION

It is the main object of the present invention to solve the problem of incapability of being kept evenness after inflation in the conventional practice.

For achieving the above object, the present invention provides a mattress with adjustable hardness comprising at least one resilience supplying module, at least one air bag module and a lining provided for the resilience supplying module and the air bag module to be placed therein, characterized in that the lining is provided with a plurality of lattice-like units, each lattice-like unit defining a mounting space therein, and that the resilience supplying module is provided with a plurality of elastic bodies respectively provided in one of the mounting spaces, and that the air bag module is provided with a plurality of air bag units respectively provided in one of the mounting spaces, the air bag units being communicated with one another and connected to an inflating device, each air bag unit being injected with air through the inflating device so as to compress one of the elastic bodies to modify the hardness of the mattress, each mounting space limiting the expanded volume of one of the air bag units after air is received, respectively.

In one embodiment, the lattice-like units are located at the same level and arranged in parallel, while each of the mounting spaces is presented in the form of a long strip and provided for one of the elastic bodies and one of the air bag units to be placed therein, in which the lattice-like units are arranged to form a rectangular pattern.

In one embodiment, the lining is provided with a plurality of strip-like structures, arranged in parallel and spaced apart from one another on an surrounding inner wall of each mounting space. Further, each of the strip-like structures is a strip-like groove or a strip-like through-hole, respectively.

In one embodiment, each of the elastic bodies is a sponge strip, respectively.

In one embodiment, each of the elastic bodies is a spring component, respectively, each spring component being provided with two plate bodies and a plurality of springs connected between the two plate bodies.

In one embodiment, in each of the mounting spaces, at least one of the elastic bodies and at least one of the air bag units are placed, respectively.

In one embodiment, the air bag module is provided with an air delivery tube, connected at the side of each of the air bag units such that the air bag units are communicated with one another, and located outside of the mounting spaces.

In one embodiment, one elastic body and one air bag unit are placed in each of the mounting spaces, respectively. The resilience supplying module is provided with a plurality of extended elastic bodies. The lining is provided with a plurality of extended units arranged on two sides of the lattice-like units, each extended unit defining an extended space provided for one of the extended elastic bodies to be placed therein, respectively.

In light of above embodiments, the present invention is provided with features, in comparison with the convention art, as follows.

In the present invention, the lining is allowed to be provided with the lattice-like units provided for the elastic body and the air bag unit to be placed therein, as well as the air bag units are allowed to communicate with one another, such that the air bag units may be inflated consistently without inconsistent expansion. Moreover, the expanded volume of each of the air bag units after inflation may be limited to be uniform by the corresponding lattice-like unit in the lining. Thereby, the problem of incapability of being kept evenness after inflation in the conventional practice is solved.

DETAILED DESCRIPTION OF THE PREFERRED EMBODIMENTS

The detailed description and technical content of the present invention will now be described in combination with drawings as follows.

Figure 1:
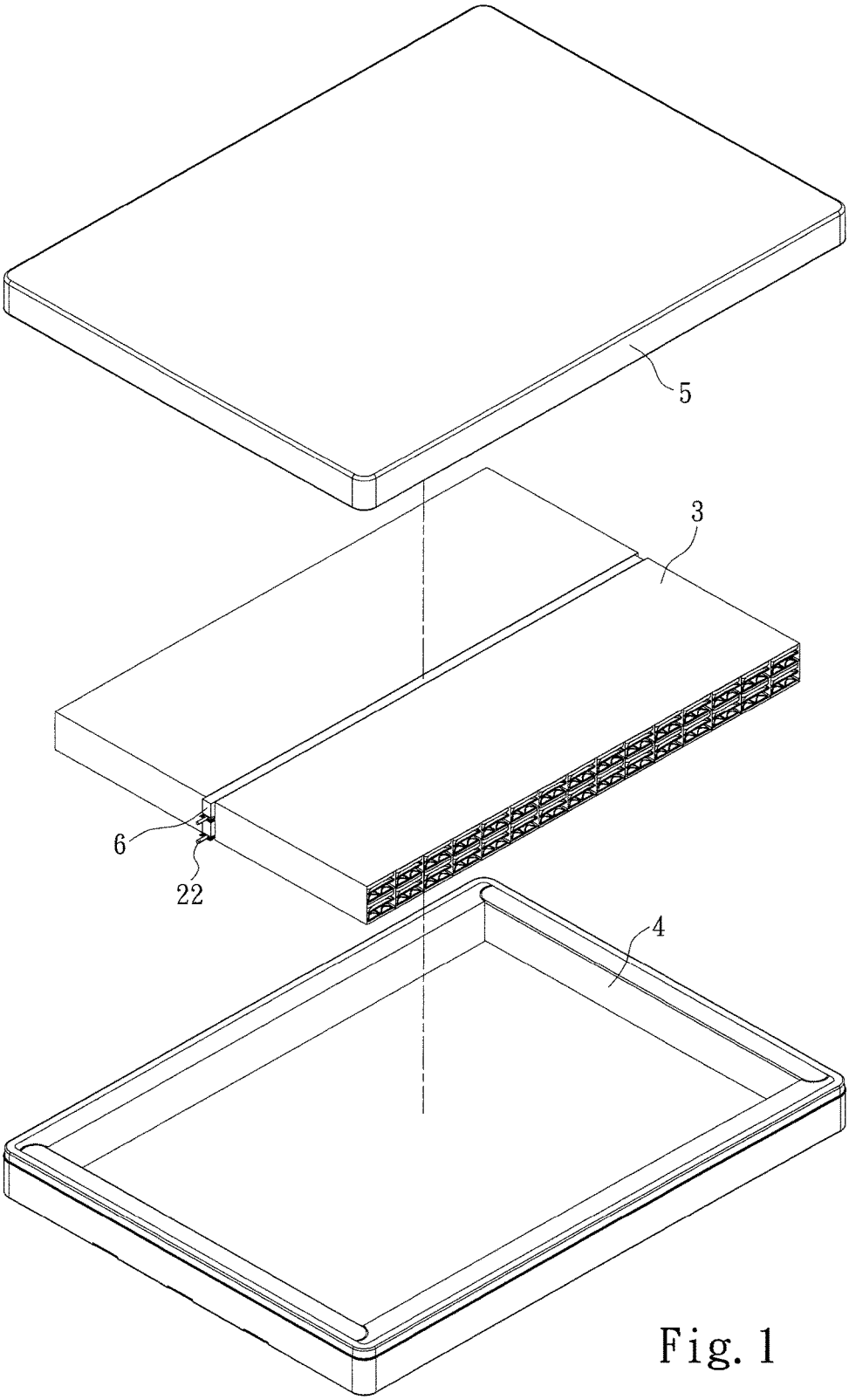
FIG. 1 is an exploded perspective diagram when the present invention is put into use.
Figure 2:
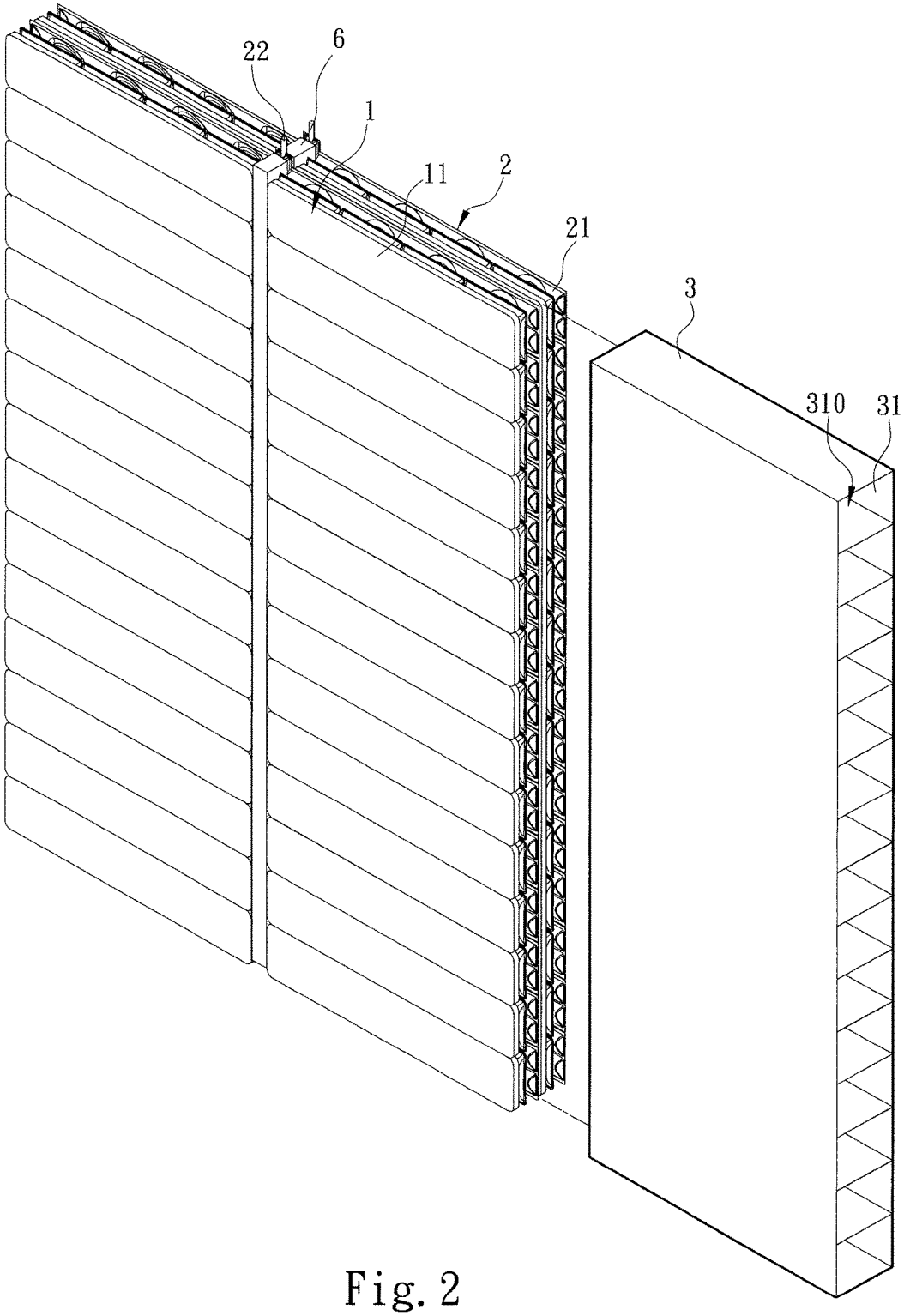
FIG. 2 is a partial exploded diagram (I) of the present invention.
Figure 3:
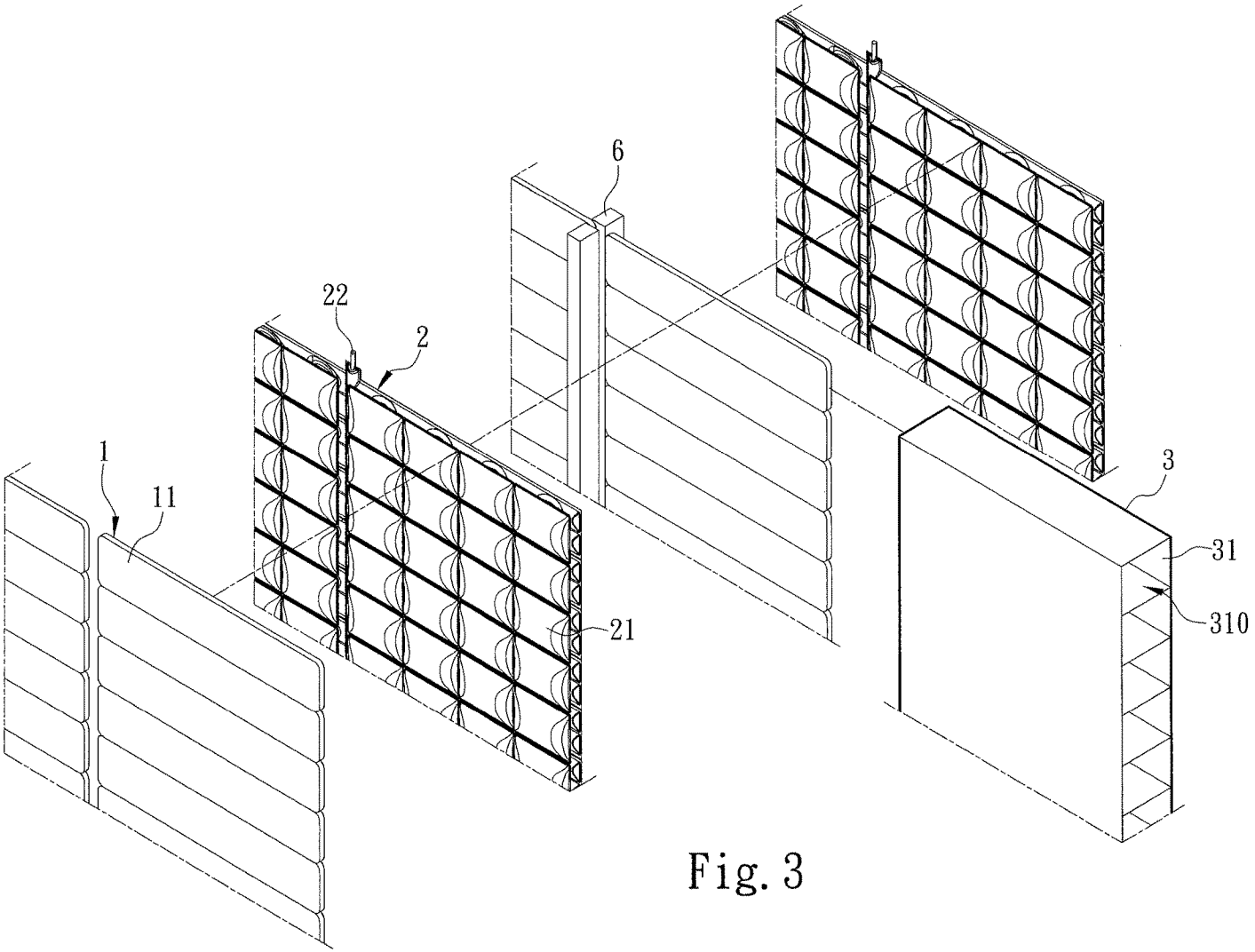
FIG. 3 is a partial exploded diagram (II) of the present invention.

Referring to FIGS. 1 to 5, the present invention provides a mattress with adjustable hardness, the mattress comprising a resilience supplying module 1, an air bag module 2 and a lining 3. The resilience supplying module 1 is provided with a plurality of elastic bodies 11, each of these elastic bodies 11 being a sponge strip, respectively (as illustrated in FIGS. 1 to 5), so as to provide primary hardness for the mattress. The air bag module 2 is provided with a plurality of air bag units 21, while the air bag units 21 and the elastic bodies 11 are of substantially the same projecting shape, as illustrated in FIGS. 2 and 3. The air bag units 21 are communicated with one another, so as to be injected with air jointly. The lining 3 is provided with a plurality of lattice-like units 31, each of the lattice-like units 31 defining a mounting space 310 therein, respectively. Moreover, each of the mounting spaces 310 is provided for one of the air bag units 21 and one of the elastic bodies 11 to be placed therein in turn. Specifically, the lattice-like units 31 are located at the same level and arranged in parallel. Each mounting space 310 is presented in the form of a long strip, and the lattice-like units 31 are arranged to form a rectangular pattern, as illustrated in FIG. 2. In each mounting space 310, at least one of the elastic bodies 11 and at least one of the air bag units 21 may be placed. In other words, each mounting space 310 may be provided for a plurality of the elastic bodies 11 and a plurality of the air bag units 21 to be placed therein. For instance, if two elastic bodies 11 and two air bag units 21 are placed in one mounting space 310, as illustrated in FIGS. 1 to 3, the two elastic bodies 11 and the two air bag units 21 are put into the mounting space 310 in a sequence of one air bag unit 21, one elastic body 11, the other air bag unit 21 and the other elastic body 11.

Figure 4:
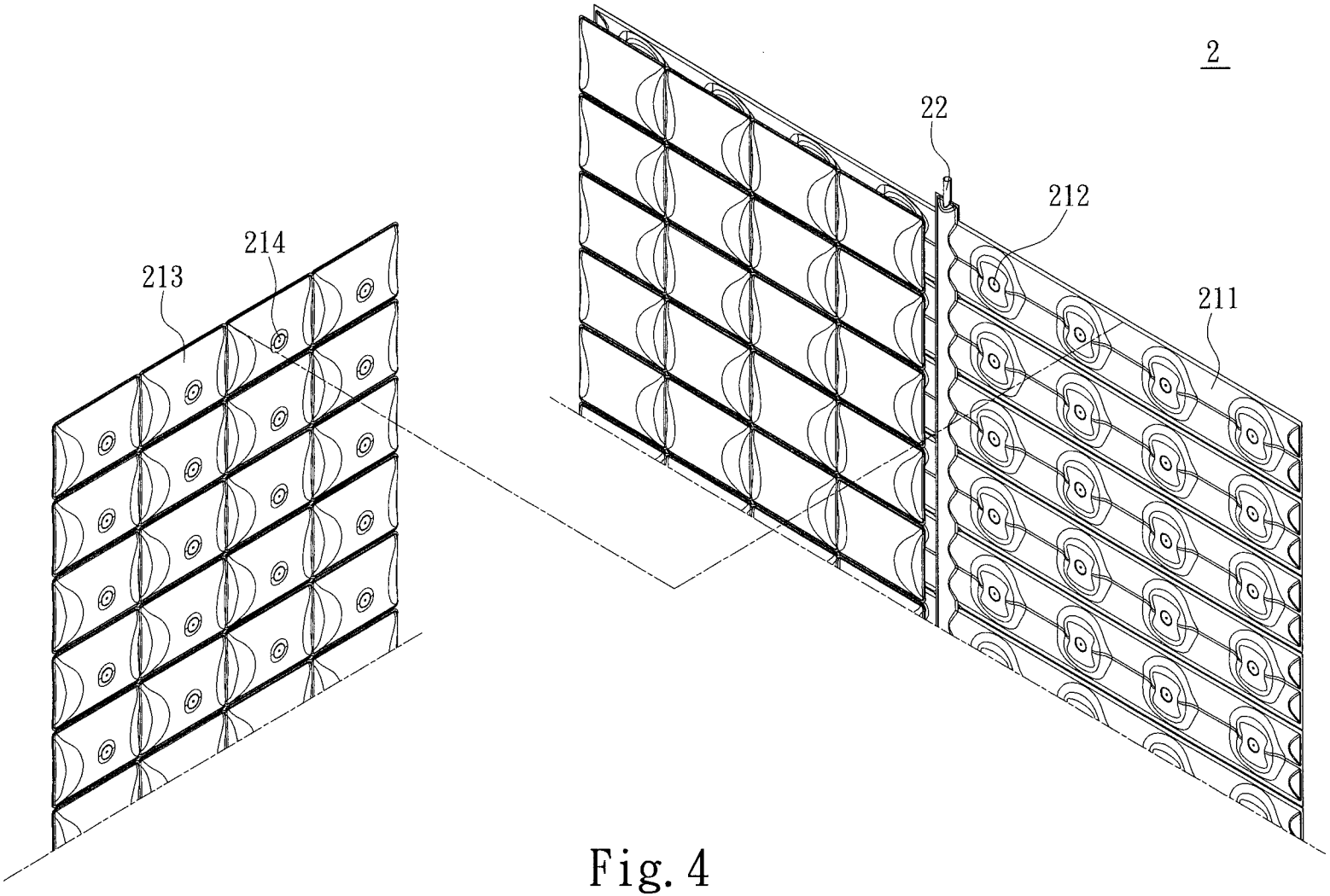
FIG. 4 is an exploded diagram of an air bag module of the present invention.
Figure 5:
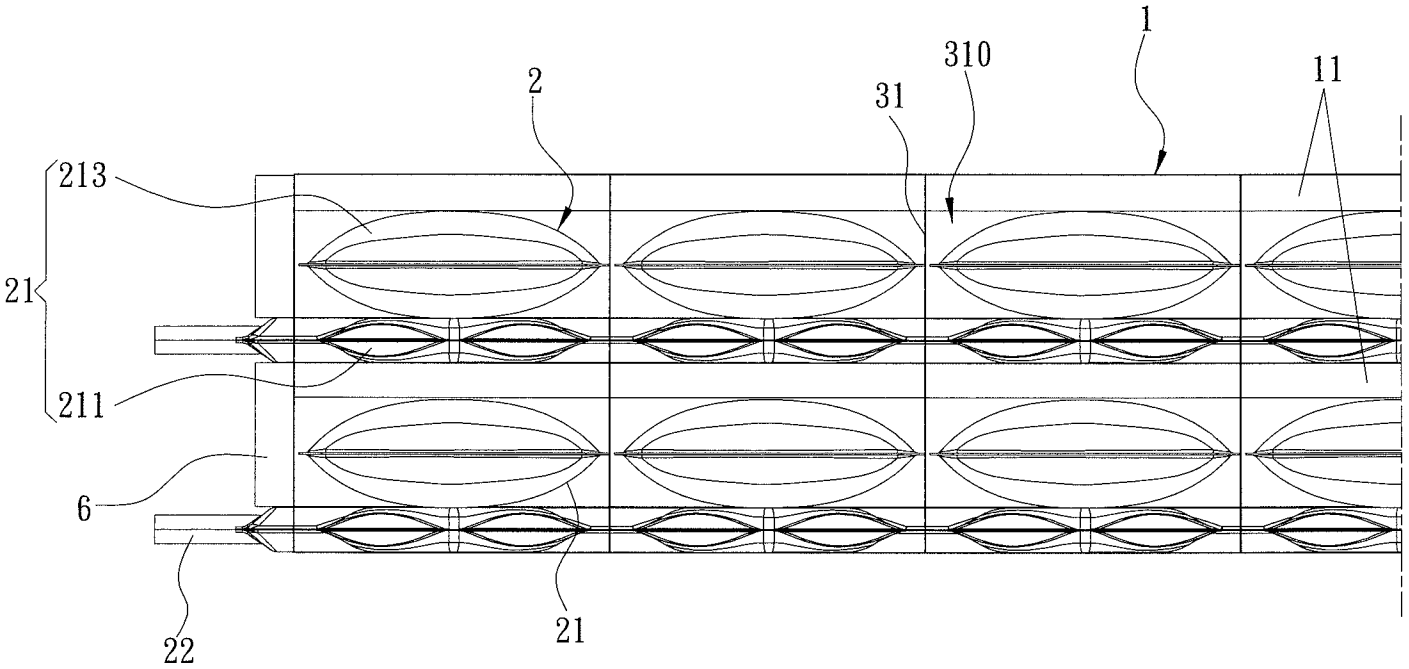
FIG. 5 is a side diagram of the present invention.

In addition, it should be noted that the air bag units 21 are communicated with one another so as to be injected with air jointly. In one embodiment, the air bag module 2 is provided with an air delivery tube 22 connected at the side of each air bag unit 21 and located outside of the mounting spaces 310 (as illustrated in FIG. 2), such that each the air bag unit 21 may be injected with air through the air delivery tube 22 jointly to be inflated. In regard to a specific pattern of one air bag unit 21, as illustrated in FIG. 4, the air bag unit 21 is provided with at least two first air bags 211, a plurality of first air-passing holes 212, a plurality of second air bags 213 and a plurality of second air-passing holes 214. The two first air bags 211 are welded to one another at the sides thereof, and communicated at one end thereof with the air delivery tube 22. The first air-passing holes 212 are provided along the connection between the two first air bags 211, and communicated with the two first air bags 211. The second air bags 213 are provided on the surface of the two first air bags 211. Each of the second air-passing holes 214 is provided on one of the second air bags 213, and communicated with one of the first air-passing holes 212, respectively.

On completion of description with respect to the fundamental pattern of the mattress, the operation process and the embodied pattern created in the course of operation of the mattress will be further described now for the present invention. During the operation of the mattress, the mattress may be placed between a base plate 4 and a mattress body 5, while the mattress may be provided, at each of two opposite sides, with two resilience supplying modules 1, two air bag modules 2 and one lining 3 (as illustrated in FIG. 1). In regard to the single-layered structure of the mattress, one air delivery tube 22 is used to communicate with the air bag units 21 at each of two sides of the mattress; i.e., one air delivery tube 22 is communicated with the air bag units 21 of only one air bag module 2. In addition, with regard to the double-layered structure of the mattress having top and bottom layers, a filler strip 6 is provided on the surface of each of the two air delivery tubes 22 for the mattress.

Here, for explaining the variation of the mattress during the adjustment of hardness clearly, the relationship among only one elastic body 11, one air bag unit 21 and one lattice-like unit 31 will be described below. In detail, primary hardness is provided by the elastic body 11 for the mattress when the air bag unit 21 is uninflated. At this time, the lowest hardness is perceived by a user lying on the mattress body 5. If increasing the hardness of the mattress is desired by the user, the inflating device may be operated to inject air into the air bag unit 21, such that the air bag unit 21 is expanded to compress the elastic body 11. Thus, the hardness of the mattress is the primary hardness provided by the elastic body 11 with added hardness provided by inflating the air bag unit 21. Accordingly, the hardness of the mattress may be then increased gradually by users to meet their own requirements. In this case, the lining 3 is provided with the lattice-like units 31, each of which is provided for the elastic body 11 and the air bag unit 21 to be placed therein, respectively. Moreover, all of the air bag units 21 are communicated with one another, such that the air bag units 21 may be inflated consistently without inconsistent expansion. Further, the expanded volume of each of the air bag units 21 after inflation may be limited to be uniform by the corresponding lattice-like unit 31 in the lining 3. As such, the problem of incapability of being kept evenness after inflation in the conventional practice is then solved.

Figure 6:
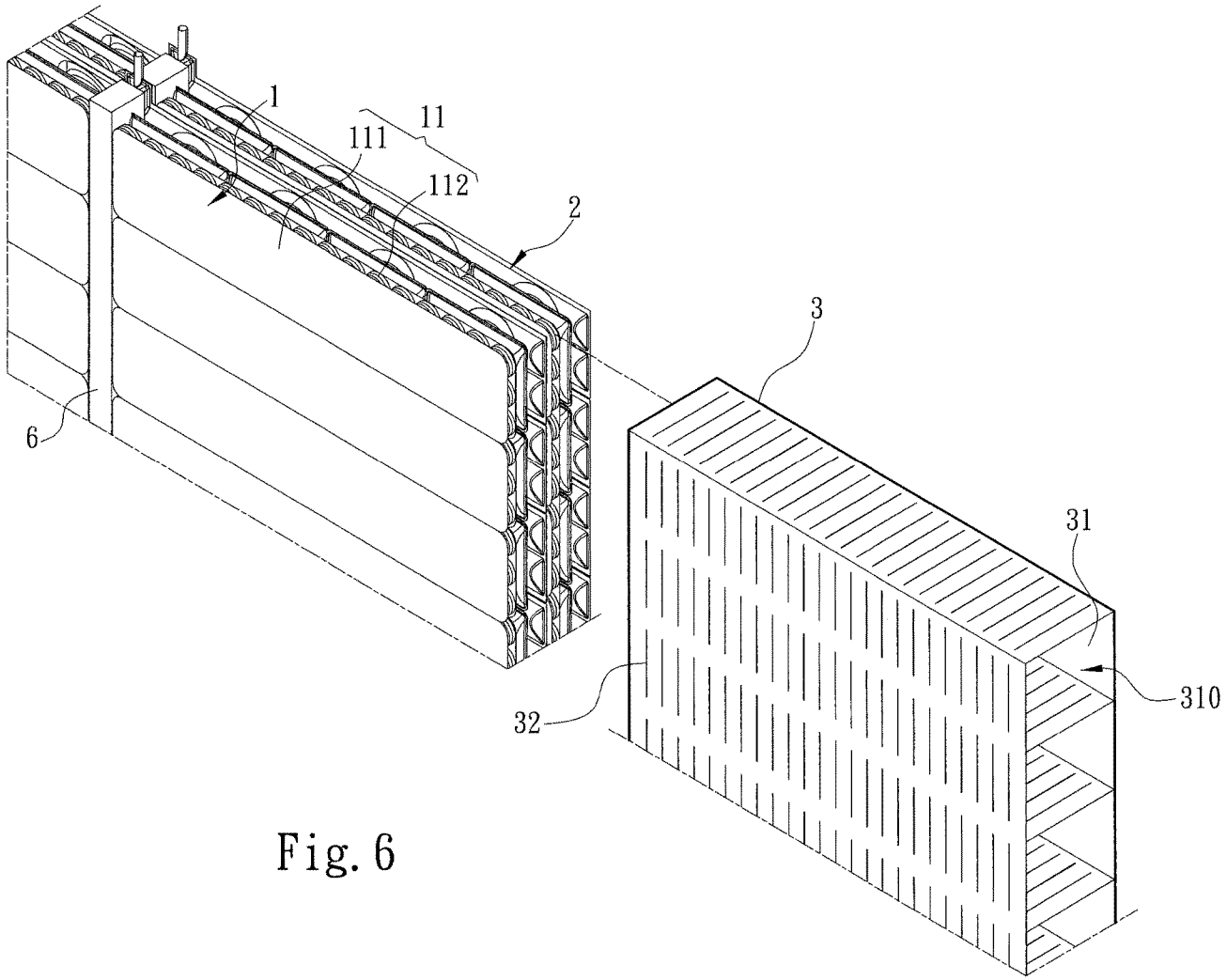
FIG. 6 is an exploded diagram of a resilience supplying module of another embodiment of the present invention.

It is apparent from above technical description that primary hardness (namely, the lowest hardness) of the mattress is provided by the elastic bodies 11 for the mattress when the air bag units 21 are uninflated. Furthermore, the constituting components of each elastic body 11 may be further selected by users depending upon their own requirements for the degree of hardness of the mattress. In one embodiment, each elastic body 11 may be a sponge strip (as illustrated in FIGS. 1 to 5). In another embodiment, each elastic body 11 may be a spring component (as illustrated in FIG. 6), each of which includes two plate bodies 111 and a plurality of springs 112 connected between two plate bodies 111. Then, different primary hardness may be created by each elastic body 11 via different constituting components (namely, the sponge strip or the spring component). In addition, it should be noted specifically, in the present invention, one of the air bag units 21 and one of the elastic bodies 11 are stacked in turn inside each lattice-like unit 31, in such a way that the user is prevented from lying on the air bag units 21 directly through the elastic body 11. In this way, the condition, in which air is squeezed aside when the air bag units 21 are pressed by the user, may be alleviated by the elastic bodies 11. Further, the problem of reaction exerted on the back of the user and thus discomfort in the back of the user, as a result of air-filled sides of the air bag units 21, is avoided.

Additionally, a slight noise due to flexure of the mattress may be generated when the user lies on the mattress body 5. Accordingly, in one embodiment as illustrated in FIG. 6, the lining 3 is further provided with a plurality of strip-like structures 32, respectively provided on the surface of each lattice-like unit 31 and arranged in parallel to one another. Each strip-like structure 32 may be a strip-like groove or a strip-like through-hole, where flexure is allowed, previously formed on the surface of each lattice-like unit 31. Thereby, the reduction in the generation of noise is achieved via flexure of the strip-like structures 32 when the user lies on the mattress body 5.

Figure 7:
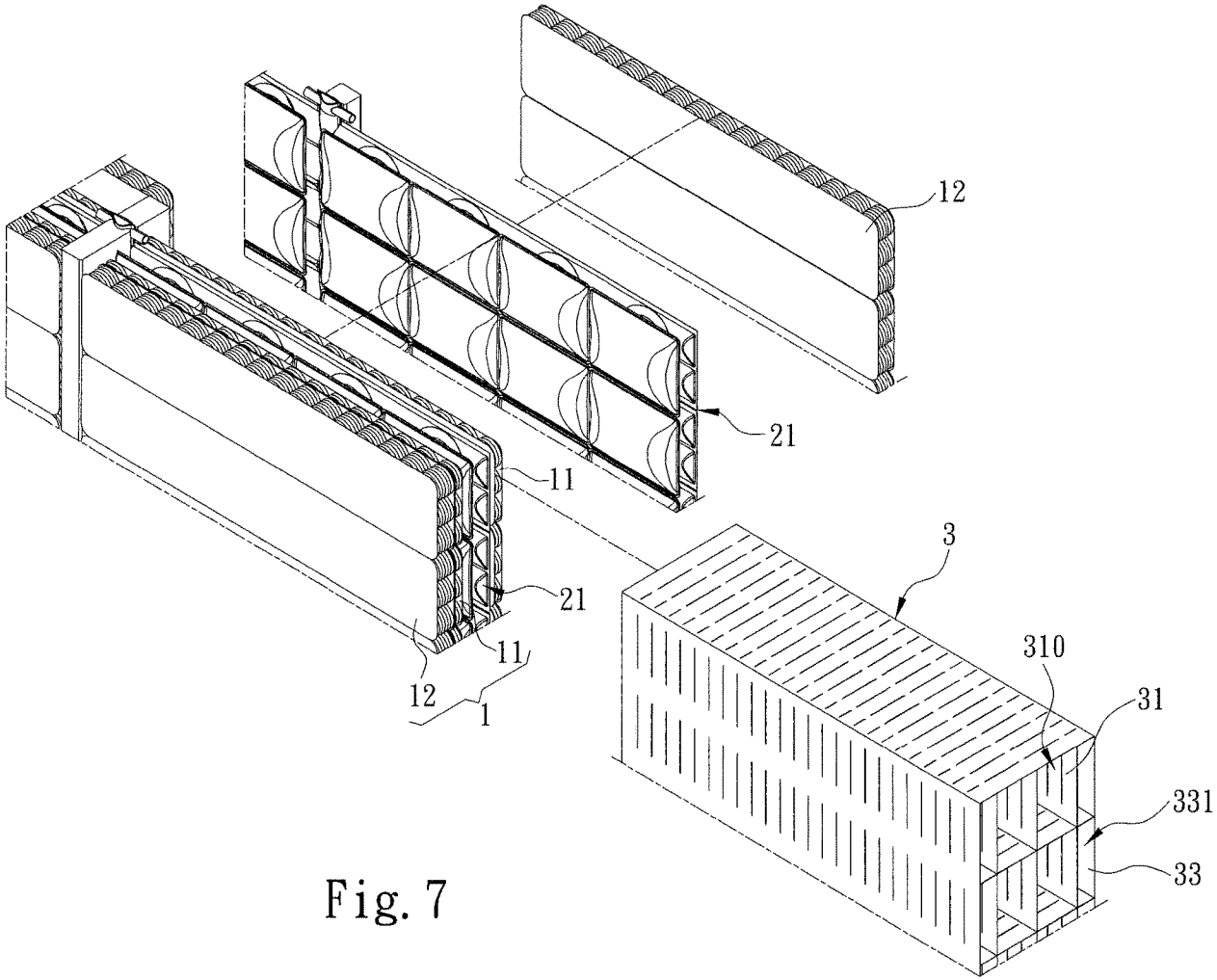
FIG. 7 is an exploded diagram of a lining of another embodiment of the present invention.

In one embodiment as illustrated in FIG. 7, in addition to the above technical content, the resilience supplying module 1 is further provided with a plurality of extended elastic bodies 12, while the lining 3 is further provided with a plurality of extended units 33, each extended unit 33 defining an extended space 331 provided for one of the extended elastic bodies 12 to be placed therein. In this case, the extended elastic bodies 12 and the elastic bodies 11 are the same in terms of structure. The extended units 33 are arranged on two sides of the lattice-like units 31. In other words, each the extended elastic body 12 may be also a sponge strip or a spring component, while the extended units 33 are provided on two side surfaces formed after the lattice-like units 31 are arranged. During the use of this embodiment, only one elastic body 11 and one air bag unit 21 are placed in the mounting space 310. In regard to the mutual relationship among one elastic body 11, one air bag unit 21, one lattice-like unit 31, two extended units 33 and two extended elastic bodies 12 in this embodiment, the condition, in which the air bag unit 21 inside the mounting space 310 compresses the two extended elastic bodies 12 together, is alleviated by putting each of the two extended elastic bodies 12 into one of the extended spaces 331, respectively, in the resilience supplying module 1, when the air bag unit 21 inside the mounting space 310 is inflated by the inflating device to compress the elastic body 11. In this way, the evenness of the surface of the mattress is kept by the two extended elastic bodies 12, while the impairment in elasticity of the elastic body 11 due to the compression from the air bag unit 21 is also compensated by the two extended elastic bodies 12 inside the two extended spaces 331, such that proper elasticity of the mattress may be still kept integrally. In addition, the problem of air inside the air bag unit 21 being squeezed aside, arising when the user lies on the air bag unit 21, is also alleviated via the elastic body 11 and the extended elastic body 12 in the mattress. Furthermore, between the two extended spaces 331, there may be provided with at least one mounting space 310; that is to way, it is also possible to provide a plurality of the mounting spaces 310, as well as one elastic body 11 and one air bag unit 21 installed in each of the mounting spaces 310, between the two extended spaces 331, as illustrated in FIG. 7.

What is claimed is:

1. A mattress with adjustable hardness, comprising at least one resilience supplying module, at least one air bag module and a lining provided for said resilience supplying module and said air bag module to be placed therein, characterized in that:

said lining is provided with a plurality of lattice-like units, each lattice-like unit defining a mounting space therein, and that said resilience supplying module is provided with a plurality of elastic bodies respectively provided in one of said mounting spaces, and that said air bag module is provided with a plurality of air bag units respectively provided in one of said mounting spaces, said air bag units being communicated with one another and connected to an inflating device, each air bag unit being injected with air through said inflating device so as to compress one of said elastic bodies to modify hardness of said mattress, each of said mounting spaces limiting the expanded volume of one of said air bag units after air is received, respectively.

2. The mattress with adjustable hardness according to claim 1, wherein said lattice-like units are located at the same level and arranged in parallel, while each of said mounting spaces is presented in the form of a long strip and provided for one of said elastic bodies and one of said air bag units to be placed therein.

3. The mattress with adjustable hardness according to claim 2, wherein said lattice-like units are arranged to form a rectangular pattern.

4. The mattress with adjustable hardness according to claim 1, wherein said lining is provided with a plurality of strip-like structures, arranged in parallel and spaced apart from one another on a surrounding inner wall of each of said mounting spaces.

5. The mattress with adjustable hardness according to claim 4, wherein each of said strip-like structures is a strip-like groove or a strip-like through-hole, respectively.

6. The mattress with adjustable hardness according to claim 1, wherein each of said elastic bodies is a sponge strip, respectively.

7. The mattress with adjustable hardness according to claim 1, wherein each of said elastic bodies is a spring component, each of said spring components being provided with two plate bodies and a plurality of springs connected between said two plate bodies, respectively.

8. The mattress with adjustable hardness according to claim 1, wherein at least one of said elastic bodies and at least one of said air bag units are placed in each of said mounting spaces, respectively.

9. The mattress with adjustable hardness according to claim 1, wherein said air bag module is provided with an air delivery tube, the air delivery tube is connected at the side of each of said air bag units such that said air bag units are communicated with one another, and the air delivery tube is located outside of said mounting spaces.

10. The mattress with adjustable hardness according to claim 1, wherein one said elastic body and one said air bag unit are placed in each of said mounting spaces, respectively, said resilience supplying module being provided with a plurality of extended elastic bodies, said lining being provided with a plurality of extended units arranged on two sides of said lattice-like units, each extended unit defining an extended space provided for one of said extended elastic bodies to be placed therein, respectively.

* * * * *